United States Patent [19]

Iafret

[11] 4,325,525

[45] Apr. 20, 1982

[54] MOUNTING MEMBER

[75] Inventor: John E. Iafret, Grand Blanc, Mich.

[73] Assignee: General Motors Corporation, Detroit, Mich.

[21] Appl. No.: 206,614

[22] Filed: Nov. 13, 1980

[51] Int. Cl.[3] ..... G12B 9/00

[52] U.S. Cl. ..... 248/27.3; 74/501 M

[58] Field of Search ..... 248/27.1, 27.3; 200/295, 296; 174/138 G; 361/403; 74/501 R, 501 M

[56] References Cited

U.S. PATENT DOCUMENTS

| | | | |
|---|---|---|---|
| 3,213,189 | 10/1965 | Mitchell et al. | 248/27.1 X |
| 3,285,548 | 11/1966 | Matto et al. | 248/27.1 |
| 3,427,894 | 2/1969 | Tschanz . | |
| 3,443,452 | 5/1969 | Shontz . | |
| 3,444,754 | 5/1969 | Liedel | 74/501 M |
| 3,488,628 | 1/1970 | Lundergan et al. | 361/403 X |
| 3,800,113 | 3/1974 | Sheahan | 248/27.1 X |
| 3,800,619 | 4/1974 | McIntyre | 74/501 M |
| 3,929,031 | 12/1975 | Webb . | |

*Primary Examiner*—J. Franklin Foss
*Attorney, Agent, or Firm*—Edward J. Biskup

[57] ABSTRACT

A mounting member for an actuator that is adapted to have the front portion thereof inserted into an opening in a support panel and to be secured thereto by a plurality of spring arms integrally formed with the mounting member. The rear portion of the mounting member is formed with a plurality of cantilevered sections which allow the actuator to be inserted into the mounting member at the rear portion thereof and serve to maintain the actuator within the mounting member.

2 Claims, 5 Drawing Figures

MOUNTING MEMBER

This invention concerns mounting members and, more particularly, a mounting member that is adapted to be connected to a support panel and house an actuator that controls a remotely located device, such as a rear view mirror on the exterior of a vehicle body.

One form of mounting member which has been used for attaching the actuator of a cable-operated, remotely controlled mirror to the vehicle instrument panel consists of a diecast bracket having integrally formed and diametrically opposed arms which are secured to the instrument panel by two retaining screws. Although this form of bracket has been successfully used in various vehicles, it has certain drawbacks—not the least of which is that the actuator is retained within the bracket by a setscrew which must be firmly seated during the assembly operation to prevent the actuator from being pushed out of the bracket during use. In addition, this form of mounting means for the actuator requires that the cables be of extra length to enable the actuator to be pulled through the instrument panel, attached to the bracket, and then returned to the instrument panel so the retaining screws can secure the bracket to the instrument panel.

Accordingly, the objects of the present invention are: to provide a new and improved mounting member which supports an actuator and incorporates integral spring arms which permit the mounting member to be automatically locked to a support panel by inserting the mounting member into an opening within the support panel; to provide a new and improved mounting member which is insertable from its one end into an opening in a support panel and is formed with flexible sections that allow an actuator to be automatically locked within the mounting member when the actuator is inserted into the mounting member from the other end thereof; to provide a new and improved mounting member for the actuator of a remotely located device that is made of a plastic material and has integral spring arms which permit the mounting member to be automatically secured to a support panel after insertion within an opening in the support panel, and that also has a plurality of integral cantilevered sections which flex in a radial direction for receiving and retaining the actuator within the mounting member; and to provide a new and improved mounting member which facilitates attachment of the actuator for a cable-operated, remotely located device to a support panel on a vehicle and does not require cables of extra length for completing the attachment.

The above objects are achieved in accordance with the present invention with a mounting member which is generally tubular in configuration and is adapted to house an actuator having a body portion, one end of which supports a control member and the other end of which is formed with an end cap. In the preferred form, the front portion of the mounting member has the configuration of a ring and is integrally connected with a plurality of flexible cantilevered sections which extend rearwardly from the front portion and are adapted to surround the periphery of the body portion of the actuator for retaining the actuator within the mounting member. In this regard, each of the cantilevered sections has a pair of radially inwardly extending tabs, one of which is hook-shaped and serves to engage the end cap of the actuator. In addition, a plurality of flexible spring arms are integrally formed with the front portion of the mounting member and are adapted to move radially inwardly towards the actuator when the mounting member is inserted into an opening in the support panel, and are adapted to move radially outwardly to engage one surface of the support panel to secure the mounting member thereto.

A more complete understanding of the present invention can be obtained from the following description when taken in conjunction with the accompanying drawings, in which.

Figure 1:
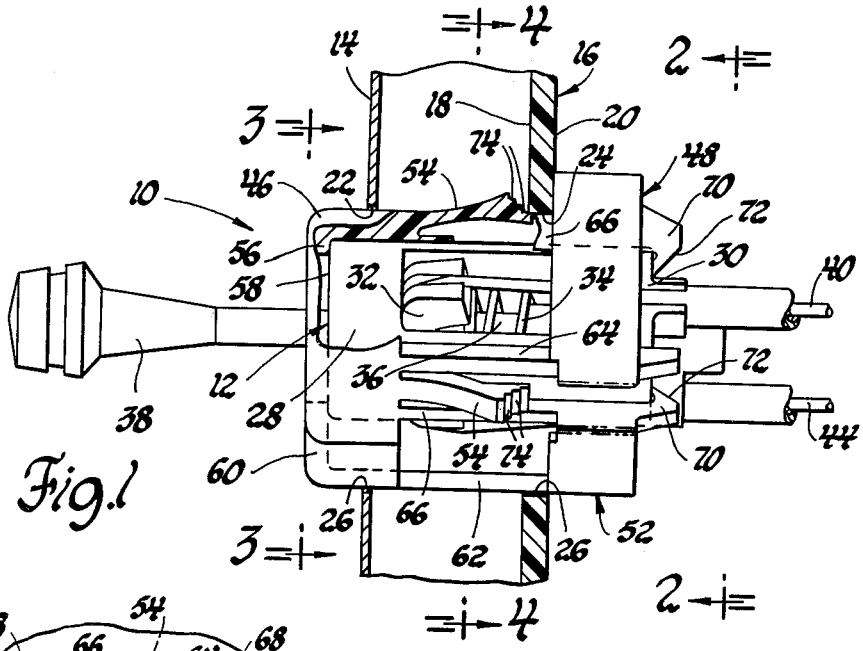
FIG. 1 is a side elevational view of a mounting member, made in accordance with the present invention, supporting an actuator for a cable-operated, remotely controlled mirror and being attached to a support panel.

Referring to the drawings and more particularly to FIG. 1 thereof, a mounting member 10, made in accordance with the invention, is shown supporting an actuator 12 of the conventional type used for controlling movement of a remotely located mirror (not shown). The mounting member 10 is attached to a panel, such as the instrument panel of a vehicle which, in this case, consists of a trim panel portion 14 and a support panel portion 16 which is provided with a front surface 18 and and a rear surface 20. The trim panel portion 14 and the support panel portion 16 are formed with identical and axially aligned generally circular openings 22 and 24, respectively, each of which is provided with an identical radially directed guide slot 26.

As seen in FIG. 1, the mounting member 10 is located within the openings 22 and 24 and is secured to the support panel portion 16 of the instrument panel in a manner which will hereinafter be more fully explained.

Figure 2:
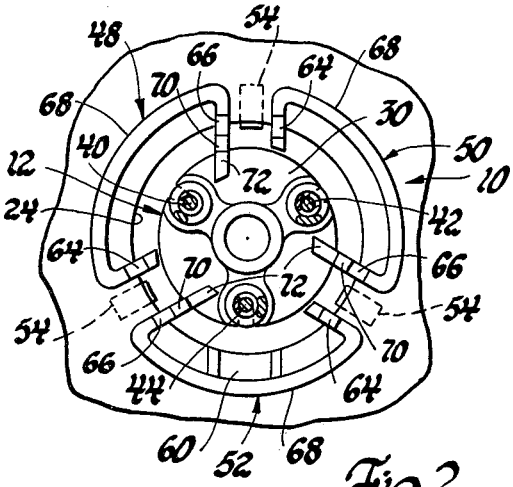
FIG. 2 is an end view of the rear portion of the mounting member, taken on line 2—2 of FIG. 1.

As seen in FIGS. 1 and 2, the actuator 12 is of generally conventional design, having a tubular body portion 28, the rear end of which is rigidly formed with an end cap 30. The body portion 28 supports a tricornered control element 32 which is biased by a coil spring 34 and through an axially movable ball stud 36 into engagement with the front end of the body portion 28. The control element 32 is universally movable by a rigidly attached hand-operated lever 38 so as to provide selective movement of one or more of the three cables 40, 42, and 44, and accordingly the mirror.

Figure 3:
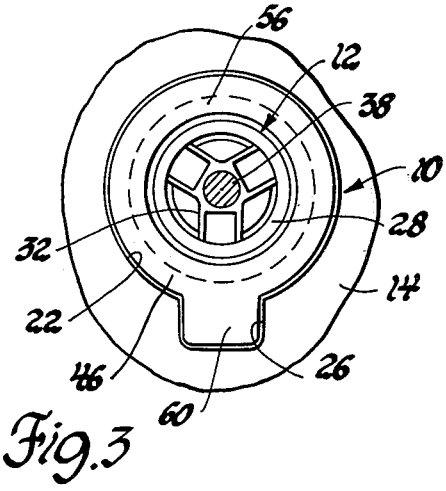
FIG. 3 is a view of the front portion of the mounting member, taken on line 3—3 of FIG. 1.
Figure 5:
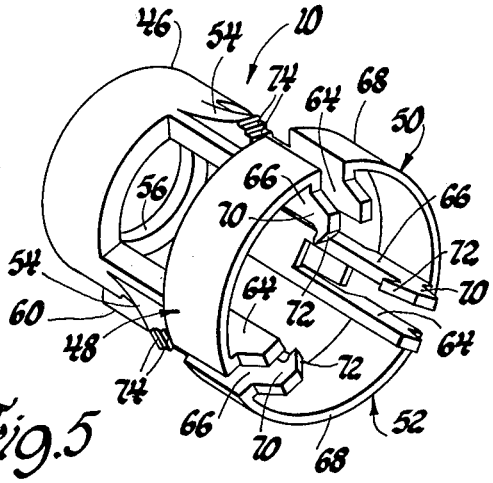
FIG. 5 is a perspective view of the mounting member shown in FIGS. 1 through 4.
Figure 4:
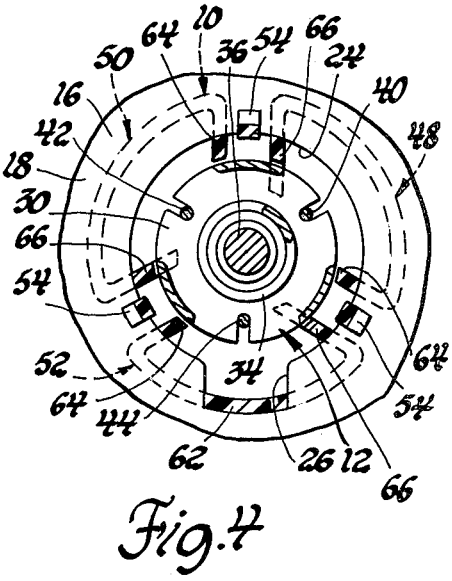
FIG. 4 is a sectional view of the mounting member, taken on line 4—4 of FIG. 1.

The mounting member 10 is a one-piece molding formed of a suitable plastic material such as Nylon, and generally comprises a ring-shaped front section 46 which is integrally formed with three circumferentially equally spaced and identical cantilevered sections 48, 50, and 52, between each adjacent pair of which is located an identical spring arm 54 integral with the front section 46. As seen in FIGS. 1 and 3, the front section 46 is formed with a radially inwardly directed flange 56 which (as seen in FIG. 1) contacts and serves as a stop or limiting means for the front edge 58 of the body portion 28 of the actuator 12. The front section 46 of the mounting member 10 is also formed with an integral locator section 60 which, in turn, is integrally formed with a rearwardly extending strut 62 connected to the cantilevered section 52. In this regard and as seen in FIGS. 2, 4, and 5, each of the cantilevered sections 48, 50, and 52 includes a pair of circumferentially spaced ribs 64 and 66—one end of each of which is integrally formed with the front section 46 of the mounting member 10. The ribs 64 and 66 extend rearwardly from the front section 46 and are interconnected at their rear ends by a curved connector member 68. As seen in FIG. 2, the connector member 68 of each of the cantilevered sections 48, 50, and 52, lies on a common circle which is concentric with the peripheral edge of the front section 46. In addition, the rear end of each rib 66 is formed with a radially inwardly extending tab 70 which (as seen in FIG. 1) serves to engage the end cap 30 formed on the rear end of the actuator 12 so that—together with the flange 56 formed with the front section 46 of the mounting member 10—axial movement of the actuator 12 relative to the mounting member 10 is prevented. The tab 70, formed with rib 66 of each of the cantilevered sections 48, 50, and 52, has an inclined surface 72 which facilitates assembly of the actuator 12 into the mounting member 10, as will hereinafter be explained.

As best seen in FIG. 2 and as aforementioned, the cantilevered sections 48, 50, and 52 are equally spaced about the circumference of the front section 46 of the mounting member 10. Also, between each adjacent pair of cantilevered sections 48, 50, 52, the spring arm 54 is provided—one end of which is integral with the front section 46 and the other end of which extends rearwardly and is formed with a plurality of identical radially outwardly directed steps or teeth 74. Each spring arm 54 is normally biased outwardly and can be moved radially inwardly upon having a force applied thereto—such as during insertion of the mounting member 10 into the opening 24 formed in the support panel portion 16 of the instrument panel. In other words, the spring arm 54 is molded in the position seen in FIG. 5 and if moved radially inwardly into the space between adjacent ribs 64 and 66 and then released, the internal elastic forces of the plastic material serves to restore the spring arm 54 to the normal molded position.

From the above it should be apparent that the mounting member 10 serves to secure the actuator 12 to the instrument panel, as shown in FIG. 1. In this connection, initially the actuator 12 is positioned within the mounting member 10, and this is achieved by first axially aligning the mounting member 10 and actuator 12 with the front edge 58 of the actuator 12 engaging the inclined surface 72 of each tab 70 formed with the cantilevered sections 48, 50, and 52. The tabs 70 initially prevent insertion of the actuator 12 into the mounting member 10; however, by manually forcing the actuator 12 towards the front section 46 of the mounting member 10, each cantilevered section 48, 50, and 52 will flex radially outwardly and will allow the actuator 12 to be moved into the mounting member 10 a distance until the front edge 58 of the actuator 12 engages the flange 56 formed with the front section 46 of the mounting member 10. The cantilevered sections 48, 50, 52, then will return to the normal molded position (as seen in FIG. 1), causing the tabs 70 to engage the end cap 30 of the actuator 12 and thereby maintain the actuator 12 within the mounting member 10. The assembled unit then is inserted into the opening 24 formed in the support panel portion 16 of the instrument panel. In this regard and as seen in FIG. 1, the front section 46 of the mounting member 10 is initially positioned in the opening 24 from the rear end thereof with the locator section 60 registering with the guide slot 26 formed with the opening 24. The mounting member 10 is then pushed into the opening 24 and the opening 22, causing the spring arm 54 to initially flex radially inwardly and then assume the position shown in FIG. 1 wherein the last tooth on each spring arm 54 engages the front surface 18 of the support panel portion 16 adjacent the opening 24, while the connector member 68 formed with the cantilevered sections 48, 50, and 52, engages the rear surface 20 of the support panel portion 16. As a result, the mounting member 10—and accordingly the actuator 12—is locked to the instrument panel.

Various changes and modifications can be made in this construction without departing from the spirit of the invention. Such changes and modifications are contemplated by the inventor, and he does not wish to be limited except by the scope of the appended claims.

The embodiments of the invention in which an exclusive property or privilege is claimed are defined as follows:

1. In combination with an actuator having a body portion with one end thereof supporting a control member and the other end thereof formed with an end cap, a mounting member for housing said actuator and connecting said actuator to a support panel having an opening formed therein, said mounting member comprising a front section for supporting one end of said actuator; a plurality of cantilevered sections integrally formed with and connected to said front section and surrounding said body portion of said actuator at substantially equally spaced intervals thereabout; each of said cantilevered sections having a pair of circumferentially spaced ribs, one of said pair of circumferentially spaced ribs being formed with a radially inwardly extending tab which is hook-shaped and serves to engage the other end of said actuator for maintaining said actuator within said mounting member; said pair of circumferentially spaced ribs extending rearwardly from said front section and being interconnected at their rear ends by a connector member; and a plurality of flexible spring arms integrally formed with said front section, said spring arms being movable radially inwardly towards said actuator when said mounting member is inserted into said opening in said support panel and being adapted to move radially outwardly to engage one surface of said support panel while said connector member engages the other surface of said support panel to thereby secure said mounting member in said opening.

2. In combination with an actuator having a cylindrical body portion with one end thereof universally pivotally supporting a control member and the other end thereof formed with an end cap for retaining a plurality of cables, a mounting member for housing said actuator and connecting said actuator to a support panel having an opening formed therein, said mounting member comprising a ring-shaped front section for supporting one end of said actuator; a plurality of cantilevered sections integrally formed with and connected to said front section at substantially equally spaced intervals about the circumference of said front section and surrounding the periphery of said body portion of said actuator; each of said cantilevered sections having a pair of circumferentially spaced ribs, one of said pair of circumferentially spaced ribs being formed with a radially inwardly extending tab which is hook-shaped and serves to engage the other end of said actuator for maintaining said actuator within said mounting member; said pair of circumferentially spaced ribs extending rearwardly from said front section and being interconnected at their rear ends by a connector member; and a plurality of flexible spring arms integrally formed with said front section between each pair of adjacent cantilevered sections, each of said spring arms having a plurality of outwardly directed teeth and being movable radially inwardly towards said actuator when said mounting member is inserted into said opening in said support panel and being adapted to move radially outwardly to have at least one of said teeth engage one surface of said support panel while said connector member engages the other surface of said support panel to thereby secure said mounting member in said opening.

* * * * *